US005662323A

United States Patent [19]

Kernen

[11] Patent Number: 5,662,323

[45] Date of Patent: Sep. 2, 1997

[54] TEMPORARY SUPPORTING DEVICE FOR PLATE-LIKE WORKPIECES WITHIN A DELIVERY STATION OF A MACHINE FOR PROCESSING WORKPIECES

[75] Inventor: Jean-Pierre Kernen, Villars-Lussery, Switzerland

[73] Assignee: Bobst SA, Lausanne, Switzerland

[21] Appl. No.: 441,401

[22] Filed: May 15, 1995

[30] Foreign Application Priority Data

May 13, 1994 [CH] Switzerland ..... 01493/94

[51] Int. Cl.[6] ..... B65H 31/12

[52] U.S. Cl. ..... 271/218; 271/217; 271/213; 271/215; 414/790.8

[58] Field of Search ..... 271/215, 217, 271/218; 414/790.8, 790, 793.4, 789.9, 793.8

[56] References Cited

U.S. PATENT DOCUMENTS

| | | | |
|---|---|---|---|
| 1,699,284 | 1/1929 | English et al. . | |
| 2,853,299 | 9/1958 | Link et al. | 271/215 |
| 2,861,805 | 11/1958 | Auek | 271/215 |
| 3,148,780 | 9/1964 | Lindemann . | |
| 3,285,607 | 11/1966 | Lindemann . | |
| 4,189,133 | 2/1980 | Arrasmith et al. | 271/217 |
| 5,322,271 | 6/1994 | Ganter | 271/213 |
| 5,360,315 | 11/1994 | Kurkowski et al. . | |
| 5,435,541 | 7/1995 | Fornay et al. | 271/218 |
| 5,538,122 | 7/1996 | Siemens | 271/215 |

FOREIGN PATENT DOCUMENTS

| | | | |
|---|---|---|---|
| 359920 | 3/1990 | European Pat. Off. | 414/790.8 |
| 0 407 728 | 6/1990 | European Pat. Off. . | |
| 38 36 984 | 5/1989 | Germany . | |
| 6127789 | 5/1994 | Japan | 271/213 |

*Primary Examiner*—William E. Terrell
*Assistant Examiner*—Khoi H. Tran
*Attorney, Agent, or Firm*—Hill, Steadman & Simpson

[57] ABSTRACT

A temporary supporting device for plate-like workpieces within a delivery station of a machine that processes the workpieces includes a grid which is movable within a cradle between a position for receiving the workpieces being released at the delivery station and a disengaged position. The cradle has a pair of grooves forming tracks for rollers on the sides of the grid to enable the movement, and the tracks enable the removal of a pair of rollers at one end so that the grid can be pivoted around an axis formed by the other pair of rollers from a horizontal orientation into a vertical position extending parallel and along one side of the delivery station.

7 Claims, 3 Drawing Sheets

TEMPORARY SUPPORTING DEVICE FOR PLATE-LIKE WORKPIECES WITHIN A DELIVERY STATION OF A MACHINE FOR PROCESSING WORKPIECES

BACKGROUND OF THE INVENTION

The present invention is directed to a temporary supporting device for plate-like workpieces, such as sheets of paper or cardboard, within a delivery station of machine that is processing these workpieces.

A machine for processing sheet-like workpieces usually includes an infeed station in which a pile of sheets is arranged. Each sheet is successively taken from the top of the pile in order to be carried onto a feeding table. Once on the feeding table, every sheet is positioned against from lays and side-marks prior to being seized on its front edge by a series of grippers mounted on a crosswise bar, whose ends are attached to a pair of lateral continuous chains which are arranged for transferring the bar and sheet in succession through the processing stations. The processing stations can consist of a die-cutting press, which is then followed by a waste stripping station. These processing stations are followed by a delivery station in which every sheet is released by the grippers end is aligned when dropping on top of a stack or pile being formed on an outlet pallet. This pallet is carded by a plate-like elevator which is lowered as the pile grows in order to keep the top of the pile at a constant level with regard to the machine or device.

When the outlet pile has a predetermined number of sheets, a temporary supporting device is inserted in the path of the dropping sheets in order to support the next sheets as the pile on the pallet is removed. In the meantime, the elevator is brought back to ground level and the full pallet is removed prior to being replaced by an empty pallet. The plate is then raised again until the empty pallet takes over supporting the weight of the new pile which is being built up, at which time the temporary supporting device is retracted to deposit the temporary pile on the pallet.

A known semi-automatic supporting device includes a horizontal track or cradle, for example a frame which carries a pair of lateral grooves, one on both sides of the pile. This device includes a so-called non-stop grid or grate which is made of a plurality of parallel and horizontal forks which are held together with crossbars connected to two lateral lengthwise beams. These lengthwise beams have, moreover, a plurality of outer rollers engaged in the grooves of the track or cradle. This arrangement allows for a manual movement of the grid in the tracks of the cradle in order to place it in direct alignment with the passage of the sheets or to move it to a retracted position to withdraw it from the path of the sheets being delivered. The cradle can be moved in translation by a vertical jack slowly downward in the course of the building up of the temporary pile on the engaged grid and quickly upward with the grid in a disengaged position for coming back to a starting position for the cradle.

It has appeared, however, that the grid in its disengaged or retracted position, although functioning satisfactorily, will protrude from the delivery station and could become an almost permanent danger for inattentive operators who could hurt themselves on it. This danger is also present if the grid is not completely engaged when being used, as in the case for the delivery of small-sized sheets and, therefore, partially protrudes from the delivery station.

SUMMARY OF THE INVENTION

An object of the present invention is to provide a supporting device which is more discreet for the full security of the operator and remains, at the same time, efficient and easy to handle.

These objects are achieved in a device which includes a non-stop grid or grate which is able to be moved horizontally forward and backward in a cradle between s position for receiving workpieces being delivered at the delivery station and a retracted position allowing passage of the workpieces onto a pallet disposed on the delivery elevator. The improvements are that, when moved to a retracted position, a portion of the grid can be partially separated from the cradle in order to allow for a complementary rotary movement that will bring the grid into a vertical position for storage. Preferably, the grid is rotated around a front edge and it takes up a position extending parallel to a side face or wall of the station. If the grid is lowered around one of its lateral lengthwise beams, it then makes up a conventional barrier very visible and, hence, less dangerous.

According to a preferred way of constructing the device, the lateral lengthwise beams supporting the grid have two pairs of outer rollers, with a front pair and a rear pair, which are engaged in two groove-like tracks arranged in the cradle on either side of the pile. More specifically, the inlet end of the grooves has an upwardly opening aperture designed to allow removal of the rear pair of rollers so that the grid can then be able to be rotated and lowered around a point or axis of rotation defined by the front rollers.

When it is foreseen that the upstream adjustable aligning member or square is also provided with a stop for the positioning of the front part of the grid, the grooves of the cradle have a length greater than the length of the grid by 20% to 30%. Thus, for small-sized sheets, the grid or grate will remain entirely within the delivery station in such a way that the grid will always remain harmlessly protected in the cradle.

In an advantageous embodiment, the downstream edge or end of a lateral wall of the cradle has a dampening device for the positioning of the lengthwise beams of the grid when in the stored or completely retracted position.

Other advantages and features of the invention will be readily apparent from the following description of the preferred embodiments, the drawings and claims.

DESCRIPTION OF THE PREFERRED EMBODIMENT

Figure 4:
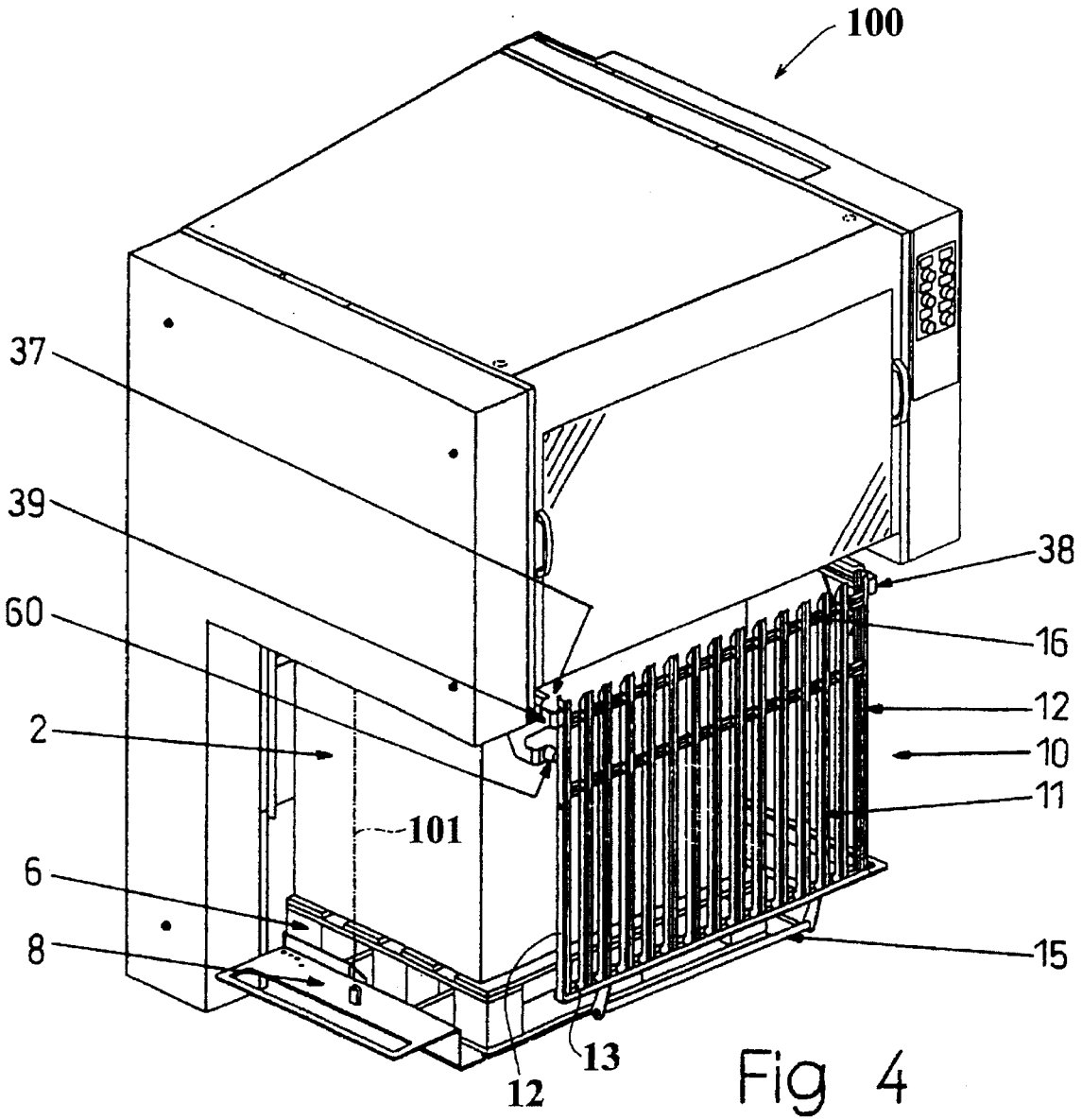
FIG. 4 is a perspective view of the downstream end of a delivery station with the grid in the disengaged or stored position.

The principles of the present invention are particularly useful when incorporated in a delivery station, generally indicated at 100 in FIG. 4. The delivery station 100 forms a pile 2 (see FIGS. 1 and 4) of plate-like workpieces that rest on a transport pallet 6, which is usually made out of wood. The pallet 6 is carried by an elevating plate 8 of an elevator which is raised and lowered by conventional means such as a chain 101 of FIG. 4.

The delivery station 100 includes a movable cradle 30, which supports a non-stop grid or grate 10 that receives a temporary pile 4 (see FIG. 1) of plate-like workpieces which will accumulate on the grid or grate after an ultimate recentering by means of a downstream guide 3, an upstream guide 3' and lateral or side guides 3". These guides are adjustable based on the size of the sheet. When describing items as "downstream" and "upstream", it should be noted that the workpieces forming the pile are entering the station in FIG. 1 in the direction of arrow 102.

More precisely, the movable cradle 30 is a frame made out of two lateral vertical walls 32 with each wall having a horizontal section with a vertical section at an upstream end of the horizontal section. The two walls are joined together on an upstream side by a horizontal reinforcing plate 33 and by a crosswise vertical wall 34. This cradle 30 is movable vertically along two guides 40 which are part of the frame of the station and are located opposite the upstream vertical section or part of the lateral wall 32. This guiding is principally obtained in the vertical direction by spaced pairs of rollers 44 belonging to the cradle 30 engaging on the guides 40, and the guide 40 has rollers 42 engaging on the lateral walls 32. The cradle 30 is moved along the vertical guides by a jack 20 which acts between a floor or base and a fastening point mounted on an offset portion 34' of the upstream wall 34.

Figure 1:
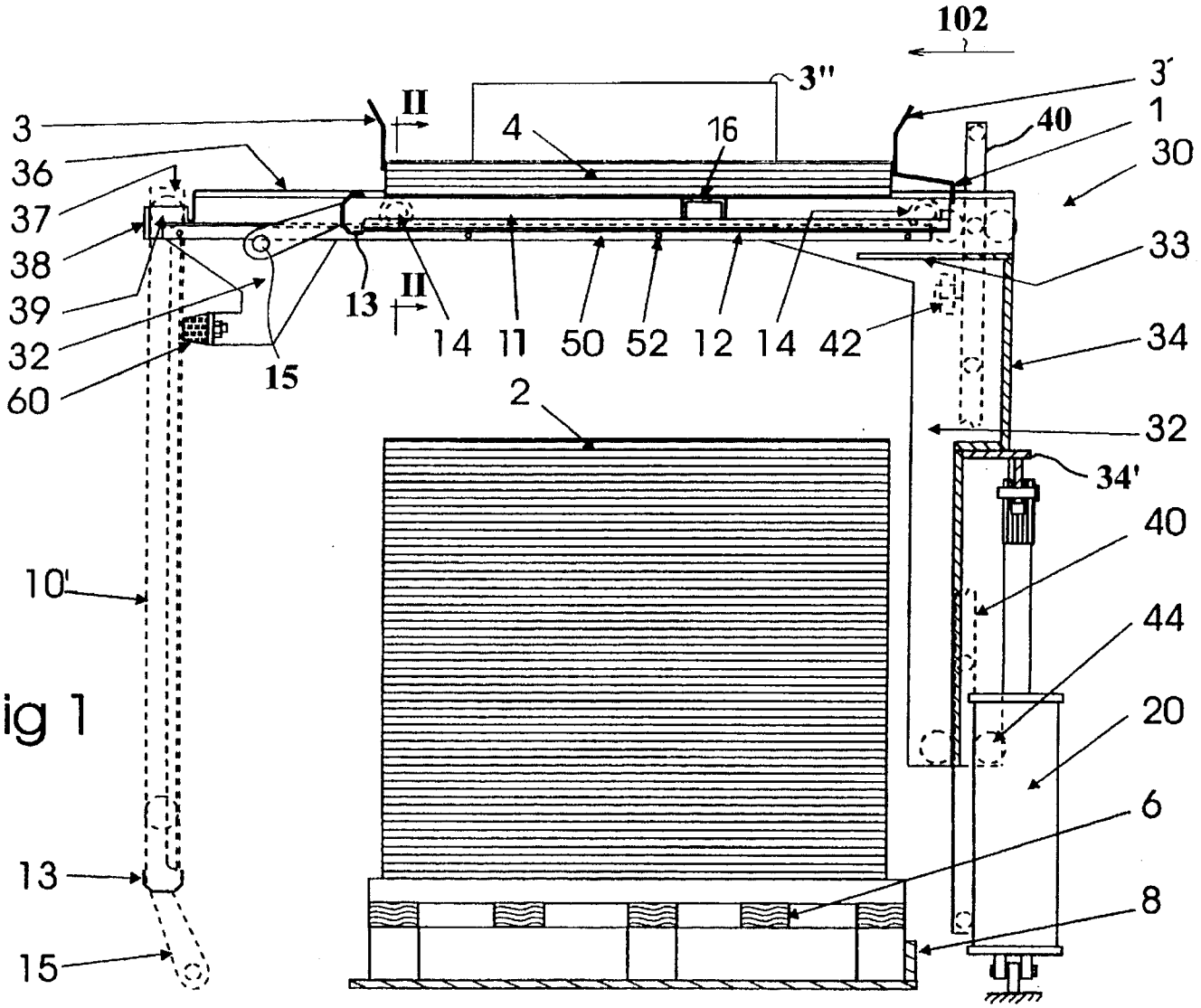
FIG. 1 is a side view with portions broken away of the temporary supporting device of the present invention disposed in a delivery station of a device.

As best illustrated in FIGS. 1 and 4, the non-stop grid 10 consists of a plurality of parallel forks 11 which are oriented in a sheet travelling direction 102. These forks 11 are linked or interconnected at their downstream end by a first crossbar 13 and on their other end by one or several complementary crossbars 16. The ends of these crossbars are secured on two lateral lengthwise beams 12 to form a rectangular grid. A handlebar 15 is mounted in the middle of the first crossbar 13.

Figure 2:
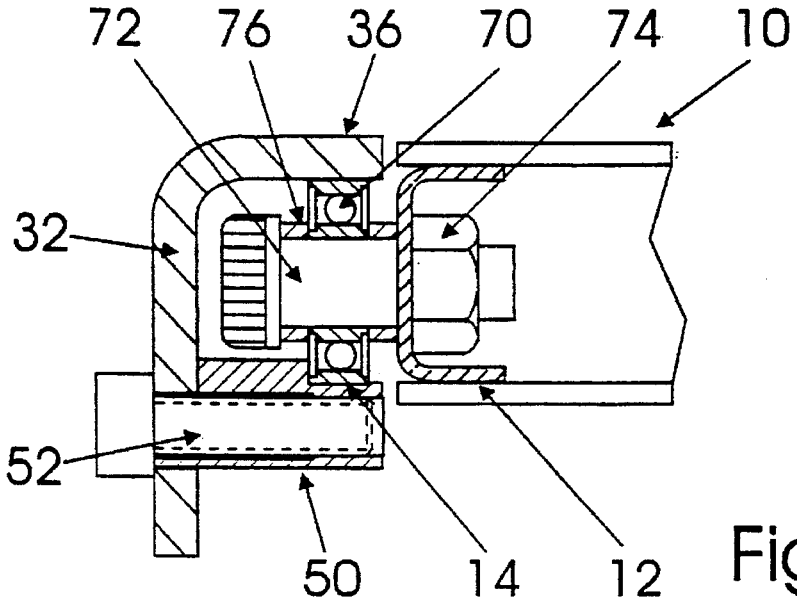
FIG. 2 is a partial cross sectional view taken along the line 11—11 of FIG. 1 with portions in elevation for purposes of illustration.

Each of the lengthwise beams 12 has a pair of rollers 14. As best illustrated in FIG. 2, each roller 14 is formed by a roller bearing 70 which is received on an axle formed by a boll 72 and centered between the head of the boll and the lengthwise beam by distance pieces or spacers 76. The bolt 72 is secured on the lengthwise beam 12 by a nut 74. Moreover, these rollers 14 are engaged on either side of the pile 2 in a horizontal groove arranged along the upper edge of each of the two lateral walls 32 of the cradle 30.

Figure 3:
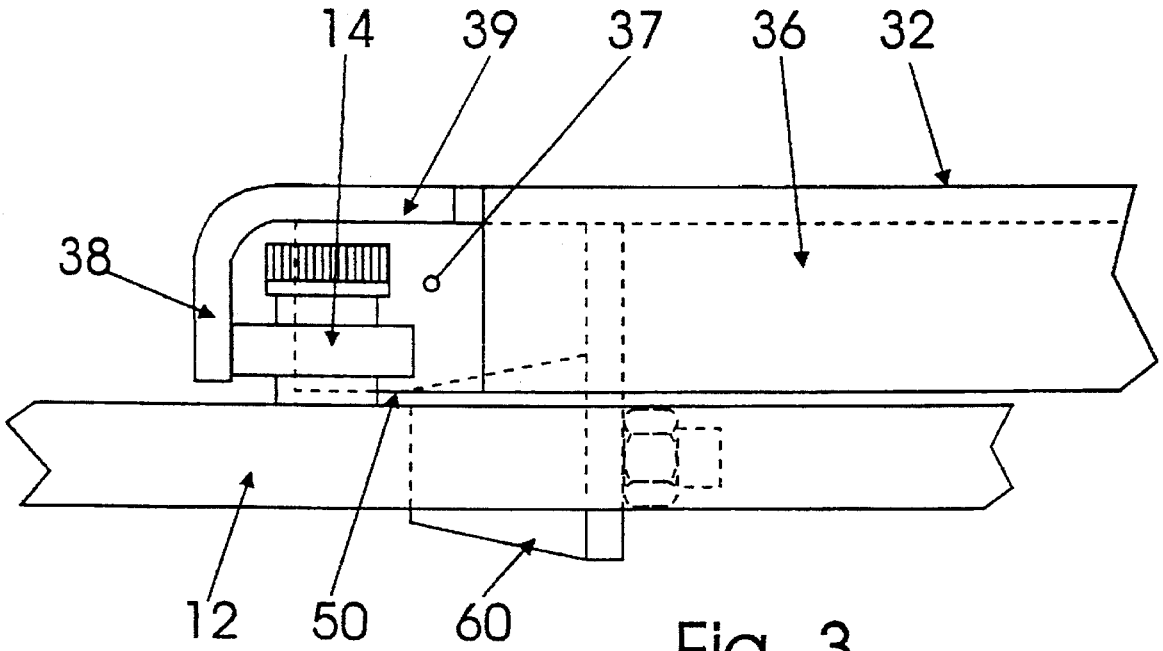
FIG. 3 is a top plan view of an inlet end of the groove.

In the way of realizing without limiting, each groove is shaped as a horizontal border or flange 36 which ends the lateral wall 32 and consists, on its lower part, of a roller track 50 mounted on the wall by means of a plurality of bolts 52, which plurality is illustrated in FIG. 1. As best illustrated in FIGS. 1 and 3, the downstream end of the groove formed by the flanges 36 and 50, which is on the left-hand side in FIG. 1, has an upwardly opening aperture 37. In other words, a groove inlet formed by this aperture is made by an extension 39 of the lateral wall 32 which ends in a horizontal corner flange forming a stop 38. The roller track 50 protrudes from the wall 32 in order to almost reach the stop 38. As illustrated in FIG. 3, this aperture 37 is much larger than the diameter of the roller 14.

In addition, a downstream lower edge of the wall 34 has an elastomer block 60 which serves as a dampening device mounted thereon. This block 60 is located in the path of the lengthwise beam 12 of the non-stop grid 10, as best illustrated in FIG. 4, so that when the grid is in the stowed position, the block engages the beams 12.

The above-described temporary supporting device is used in the following way. During the setting of the delivery station according to the size of the plate-like workpieces, the position of the downstream guide 3 and upstream guide 3' is adjusted. The upstream guide 3' has a lower stop 1 which defines the final working position for the grid 10.

Thus, when a built-up pile 2 is in the process of being carded out of the machine, the non-stop grid 10 is engaged in the movable cradle 30 and moved to a supporting position for supporting a temporary pile 4, which position is defined by the stop 1. As can be seen, the length of the lateral walls 32 and, hence, the groove formed by the flange 36 and the track 50 is slightly longer (approximately 20% to 30%) than the length of the grid 10 so that, even with reduced sizes, the grid remains within the delivery station and, hence, inoffensive to the operator.

When the new empty pallet is raised by the plate 8 of the elevator and has taken over the weight of the temporary pile 4, the now free non-stop grid 10 can be pulled back toward the retracted position by being shifted toward the left, as illustrated in FIG. 1. When the first or rear pair of rollers 14' reach the stop 38, the end crossbar 13 of the grid can be raised by lifting on the handle 15 in order to raise the first pair of rollers 14' through the vertical aperture 37 and out of the groove.

With the rollers 14' freed from the track or groove of the cradle 30, a continuation of the motion in the backward horizontal direction can be coupled with the rotation of the grid around the front rollers 14, which action allows a simultaneously lowering of the end having the first pair of rollers 14' to a new vertical resting position 10' illustrated in FIG. 1. As illustrated in FIGS. 1 and 4, this downward position extend parallel to one of the walls of the delivery station, such as the end wall. In this position, the front rollers 14 will rest on the stop 38, whereas the lengthwise beams 12 rest on the dampening devices or pads 60 in this position, the grid which is not in use is no danger to the operator who has to move around the machine.

Although various minor modifications may be suggested by those versed in the art, it should be understood that I wish to embody within the scope of the patent granted hereon all such modifications as reasonably and properly come within the scope of my contribution to the art.

I claim:

1. In a temporary supporting device for plate-like workpieces within a delivery station of a machine that processes plate-like workpieces, said device including a cradle and a non-stop grid which is movable in said cradle between a horizontal oriented sheet receiving position to form a pile of sheets and a retraced position withdrawn from receiving sheets, the improvements comprising a pair of spaced rollers attached to an end of said cradle, a vertically extending guide for guiding said spaced rollers in a vertical path, a vertical jack, said cradle being movable along said vertically extending guide in the station by said vertical jack in response to the amount of the supported plate-like workpieces, and that while being shifted to the retracted position, said grid being partially separated from the cradle in order to allow for a complementary rotational movement of the grid that will bring the grid into a vertical position in the station.

2. In a temporary supporting device according to claim 1, wherein the grid is pivoted around an edge of the grid and takes up a position extended parallel to a face of the station.

3. In a temporary supporting device according to claim 2, wherein the grid has a pair of lateral lengthwise beams, with each beam having two rollers, said rollers being engaged in two grooves provided in the cradle on either side of the pile, an inlet end of the grooves has an upwardly opened aperture enabling removal of a rear pair of the rollers out of the groove so that the grid can then be pivoted around the axis formed by a front pair of the rollers.

4. In a temporary supporting device for plate-like workpieces within a delivery station of a machine that processes plate-like workpieces, which station has an upstream adjustable aligning member for a pile, said device including a non-stop grid and a cradle, said grid being movable in said cradle between a horizontal oriented sheet receiving position and a retracted position withdrawn from receiving sheets, the improvements comprising said cradle having two grooves on either side of the pile the grid having a pair of lateral lengthwise beams, with each beam having two rollers, said rollers being engaged in said two grooves, an inlet end of the grooves having an upwardly opened aperture enabling removal of a rear pair of the rollers out of the groove to partially separate the grid from the cradle and to allow the grid to be pivoted around an axis formed by a first pair of rollers into a vertical position extending parallel to a face of the station, said aligning member being provided with a stop for positioning a front part of the grid, and a length of the grooves of the cradle being greater than the length of the grid by approximately 20% to 30.

5. In a temporary supporting device according to claim 4, wherein the cradle has lateral walls, a downstream edge of the lateral walls being provided with a dampening device for positioning of the lengthwise beams of the grid while in the stored position.

6. In a device for temporarily supporting plate-like workpieces within a delivery station of a machine processing the plate-like workpieces, said device including a non-stop grid and a vertically movable cradle, said grid being movable in said cradle between a position for receiving workpieces being deposited at the delivery station and a retracted position, the improvements comprising said cradle having grooves and the grid being provided with a first pair of rollers at one end and a second pair of rollers at the other end, said rollers being received in said grooves of the cradle, said grooves at one end having an upwardly facing aperture to enable removing a pair of rollers of the grid so that the grid can be raised and then pivoted around an axis formed by the other pair of rollers into a vertical storage position along a side of the delivery station, each groove having a length greater than a length of the grid by an amount in a range of 20% to 30% of the length of the grid.

7. In a temporary supporting device according to claim 1, wherein the delivery station has an upstream adjustable aligning member for a pile, said aligning member being provided with a stop for positioning the grid in the horizontal oriented sheet receiving position.

* * * * *